US009152094B2

(12) United States Patent
Wu et al.

(10) Patent No.: US 9,152,094 B2
(45) Date of Patent: Oct. 6, 2015

(54) NANODIAMOND-CONTAINING CHECK FILM FOR TRANSFER ASSIST BLADE APPLICATIONS

(71) Applicant: XEROX CORPORATION, Norwalk, CT (US)

(72) Inventors: Jin Wu, Pittsford, NY (US); Jonathan H. Herko, Walworth, NY (US); John J. Wilbert, Macedon, NY (US); Kyle B. Tallman, Perry, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/178,860

(22) Filed: Feb. 12, 2014

(65) Prior Publication Data

US 2015/0227088 A1 Aug. 13, 2015

(51) Int. Cl.

| | |
|---|---|
| ***G03G 15/00*** | (2006.01) |
| ***G03G 15/16*** | (2006.01) |
| ***B05D 5/00*** | (2006.01) |

(52) U.S. Cl.

CPC ..... *G03G 15/162* (2013.01); *B05D 5/00* (2013.01); *B05D 2203/30* (2013.01); *G03G 2215/1628* (2013.01)

(58) Field of Classification Search

CPC ..... G03G 2215/1628
USPC ..... 399/166
See application file for complete search history.

(56) References Cited

U.S. PATENT DOCUMENTS

| | | | | |
|---|---|---|---|---|
| 8,447,210 | B2 | 5/2013 | Montfort et al. | |
| 2010/0248108 | A1 * | 9/2010 | Wu et al. | 430/104 |
| 2010/0285304 | A1 * | 11/2010 | Wu | 428/323 |
| 2015/0104226 | A1 * | 4/2015 | Wu et al. | 399/316 |

OTHER PUBLICATIONS

Jin Wu et al. "Transfer Assist Members", U.S. Appl. No. 13/968,327, filed Aug. 15, 2013.

* cited by examiner

*Primary Examiner* — David Gray
*Assistant Examiner* — Tyler Hardman
(74) *Attorney, Agent, or Firm* — MH2 Technology Law Group LLP

(57) ABSTRACT

A transfer assist blade including a plurality of layers, one of the layers being a check film layer including a thermoplastic layer and a plurality of nanodiamonds.

18 Claims, 4 Drawing Sheets

NANODIAMOND-CONTAINING CHECK FILM FOR TRANSFER ASSIST BLADE APPLICATIONS

TECHNICAL FIELD

This disclosure is generally directed to transfer assist members including a plurality of layers, one of which layers is a check film layer including a thermoplastic overcoat layer comprising a nanodiamond on a polymer layer.

BACKGROUND

In the process of xerography, a light image of an original to be copied is typically recorded in the form of a latent electrostatic image upon a photosensitive or a photoconductive member with subsequent rendering of the latent image visible by the application of particulate thermoplastic material, commonly referred to as toner. The visual toner image can be either fixed directly upon the photosensitive member or the photoconductor member, or transferred from the member to another support, such as a sheet of plain paper, with subsequent affixing by, for example, the application of heat and pressure of the image thereto.

To affix or fuse toner material onto a support member like paper, by heat and pressure, it is usually necessary to elevate the temperature of the toner and simultaneously apply pressure sufficient to cause the constituents of the toner to become tacky and coalesce. In both the xerographic as well as the electrographic recording arts, the use of thermal energy for fixing toner images onto a support member is known.

One approach to the heat and pressure fusing of toner images onto a support has been to pass the support with the toner images thereon between a pair of pressure engaged roller members, at least one of which is internally heated. For example, the support may pass between a fuser roller and a pressure roller. During operation of a fusing system of this type, the support member to which the toner images are electrostatically adhered is moved through a nip formed between the rollers with the toner image contacting the fuser roll thereby to effect heating of the toner images within the nip.

The process of transferring charged toner particles from an image bearing member marking device, such as a photoconductor, to an image support substrate like a sheet of paper involves overcoming cohesive forces holding the toner particles to the image bearing member. The interface between the photoconductor surface and image support substrate may not in many instances be optimal, thus, problems may be caused in the transfer process when spaces or gaps exist between the developed image and the image support substrate. One aspect of the transfer process is focused on the application and maintenance of high intensity electrostatic fields in the transfer region for overcoming the cohesive forces acting on the toner particles as they rest on the photoconductive member. Control of these electrostatic fields and other forces is a factor to induce the physical detachment and transfer of the charged toner particles without scattering or smearing the developer material. Mechanical devices that force the image support substrate into contact with the image bearing surface have also been incorporated into transfer systems.

More specifically, the process of transferring charged toner particles from an image bearing member, such as a photoconductive member, to an image support substrate, such as the copy sheet, may be accomplished by overcoming adhesive forces holding the toner particles to the image bearing member. In general, transfer of developed toner images in electrostatographic applications has been accomplished via electrostatic induction using a corona generating device, wherein the image support substrate is placed in direct contact with the developed toner image on the photoconductive surface while the reverse side of the image support substrate is exposed to a corona discharge. This corona discharge generates ions having a polarity opposite that of the toner particles, thereby electrostatically attracting and transferring the toner particles from the photoreceptive member to the image support substrate.

In the electrostatic transfer of the toner powder image to the copy sheet, it is necessary for the copy sheet to be in uniform intimate contact with the toner powder image developed on the photoconductive surface. Unfortunately, the interface between the photoreceptive surface and the copy substrate is not always optimal. In particular, non-flat or uneven image support substrates, such as copy sheets that have been mishandled, left exposed to the environment or previously passed through a fixing operation, such as heat and/or pressure fusing, tend to promulgate imperfect contact with the photoreceptive surface of the photoconductor. Further, in the event the copy sheet is wrinkled, the sheet will not be in intimate contact with the photoconductive surface and spaces, or air gaps will materialize between the developed image on the photoconductive surface and the copy sheet. Problems may occur in the transfer process when spaces or gaps exist between the developed image and the copy substrate. There is a tendency for toner not to transfer across these gaps, causing variable transfer efficiency and, in the extreme, can create areas of low or no transfer resulting in a phenomenon known as image transfer deletion. Clearly, an image deletion is very undesirable in that useful information and indicia are not reproduced on the copy sheet.

As described herein, the typical process of transferring development materials in an electrostatographic system involves the physical detachment and transfer over of charged toner particles from an image bearing photoreceptive surface into attachment with an image support substrate via electrostatic force fields. Thus, an aspect of the transfer process is focused on the application and maintenance of high intensity electrostatic fields in the transfer region for overcoming the adhesive forces acting on the toner particles as they rest on the photoreceptive member. In addition, other forces, such as mechanical pressure or vibratory energy, have been used to support and enhance the transfer process. Careful control of these electrostatic fields and other forces can be required to induce the physical detachment and transfer over of the charged toner particles without scattering or smearing of the developer material.

With the advent of multicolor electrophotography, it is desirable to use an architecture which includes a plurality of image forming stations. One example of the plural image forming station architecture utilizes an image-on-image (101) system in which the photoreceptive member is recharged, reimaged and developed for each color separation. This charging, imaging, developing and recharging, reimaging and developing, all followed by transfer to paper, can be completed in a single revolution of the photoreceptor in so-called single pass machines, while multipass architectures form each color separation with a single charge, image and develop, with separate transfer operations for each color.

Mechanical devices, such as rollers, have been used to force the image support substrate into intimate and substantially uniform contact with the image bearing surface. For example, there can be selected an electrically biased transfer roll system in an attempt to minimize image deletions. In other electrophotographic printing machines, such as the color producing Xerox Corporation 1065 machine, the copy sheet is provided with a precisely controlled curvature as it enters the transfer station for providing enhanced contact pressure.

However, the interface between the image bearing surface and the print sheet is rarely uniform. Print sheets that have been mishandled, left exposed to the environment, or previously passed through a fixing operation, such as heat and/or pressure fusing, tend to be non-flat or uneven. An uneven print sheet makes uneven contact with the image bearing surface. In the event that the print sheet is wrinkled, the sheet will not be in continuous intimate contact with the image bearing surface. Wrinkles in the sheet cause spaces or air gaps to materialize between the developed toner powder image on the image bearing surface and the print sheet. When spaces or gaps exist between the developed image and the print sheet, various problems may result. For example, there is a tendency for toner not to transfer across the gaps, causing variable transfer efficiency and creating areas of low toner transfer or even no transfer; a phenomenon known as image transfer deletion.

Image transfer deletion is undesirable in that portions of the desired image may not be appropriately reproduced on the print sheet. The area of a transfer assist blade (TAB) that contacts the photoreceptor will, in most instances, pick up residual dirt and toner from the photoreceptor surface. The next job run, which processes print sheets having a dimension greater than 10 inches, will have the residual dirt on the transfer assist blade transferred to the back side of the print sheet, resulting in an unacceptable print quality defect. More importantly, continuous frictional contact between the blade and the photoreceptor may cause permanent damage to the photoreceptor.

In single pass color machines, it is desirable to cause as little disturbance to the photoreceptor as possible so that motion errors are not propagated along the belt to cause image quality and color separation registration problems. One area that has potential to cause such a disturbance is when a sheet is released from the guide after having been brought into contact with the photoreceptor for transfer of the developed image thereto. This disturbance, which is often referred to as trail edge flip, can cause image defects on the sheet due to the motion of the sheet during transfer caused by energy released due to the bending forces of the sheet. Particularly in machines which handle a large range of paper weights and sizes, it is difficult to have a sheet guide which can properly position any weight and size sheet while not causing the sheet to oscillate after having come in contact with the photoreceptor.

There is a need for transfer assist members that substantially avoid or minimize the disadvantages illustrated herein.

Also, there is a need for transfer assist members that are wear resistant and that can be used for extended time periods without being replaced.

There is also a need for toner developed images transfer assist members that permit the continuous contact between a photoconductor and the substrate to which the developed toner image is to be transferred, and an apparatus for enhancing contact between a copy sheet and a developed image positioned on a photoconductive member.

Yet another need resides in providing xerographic printing systems, inclusive of multi-color generating systems, where there is selected a transfer assist member that maintains sufficient constant pressure on the substrate to which a developed image is to be transferred, and to substantially eliminate air gaps between the sheet and the photoconductor in that the presence of air gaps can cause air breakdown in the transfer field.

Further, there is a need for transfer assist members that enable suitable and full contact of the developed toner image present on a photoconductor and a substrate to which the developed image is to be transferred.

Additionally, there is a need for transfer assist members that contain durable compositions that can be economically and efficiently manufactured, and where the amount of energy consumed is reduced.

Yet additionally there is a need for a multilayered transfer assist member that includes as one layer a check film on the side exposed to a dicorotron/corona, and which member possesses excellent resistance characteristics.

Also, there is a need for transfer assist members where the check film layer can be generated roll to roll by economically extrusion processing.

Further, there is a need for transfer assist members with a combination of excellent durability that exert sufficient constant pressure on a substrate and permit the substrate to fully contact the toner developed image on a photoconductor, which members provide mechanical pressure about 20 percent of its function and electrostatic pressure/tailoring about 80 percent of its function, and where complete transfer to a sheet of a developed image contained a photoconductor results, such as for example, about 90 to about 100 percent, from about 90 to about 98 percent, from about 95 to about 99 percent, and in embodiments about 100 percent of the toner image is transferred to the sheet or a substrate, and wherein blurred final images are minimized or avoided.

Moreover, there is a need for composite transfer assist blades that overcome or minimize the problems associated with a single component blade, as a single component blade in order to be flexible enough to prevent image damage does not provide enough contact force to the back of the sheet to enable complete image transfer giving rise to transfer deletions and color shift. When a thick enough blade is used, the stress on the single blade material is high.

Yet, there is another need for transfer assist members that include check films, and which members are useful in electrophotographic imaging apparatuses, including digital printing where the latent image is produced by a modulated laser beam, or ionographic printing where charge is deposited on a charge retentive surface in response to electronically generated or stored images.

These and other needs are achievable in embodiments with the transfer assist members and components thereof disclosed herein.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a transfer assist blade may include a check film layer having a thermoplastic overcoat layer on a polymer layer. The overcoat layer may include a polycarbonate, a polyester, a carbon black, a plurality of nanodiamonds, and a plasticizer.

In another embodiment, a method for forming a transfer assist blade check film may include mixing a polycarbonate, a polyester, a carbon black, a plurality of nanodiamonds, and a plasticizer with a solvent, filtering the overcoat mixture to obtain a final dispersion, coating on a polymer layer with the final dispersion, and curing the final dispersion to remove the solvent.

BRIEF DESCRIPTION OF THE DRAWINGS

The following FIGS. are provided to further illustrate the transfer assist members disclosed herein, and where the arrows when present illustrate the direction of movement of the various components shown.

It should be noted that some details of the FIGS. have been simplified and are drawn to facilitate understanding of the present teachings rather than to maintain strict structural accuracy, detail, and scale.

DETAILED DESCRIPTION

The disclosed transfer assist members (e.g., transfer assist blades) include a layer of a thermoplastic, and more specifically, a partially conductive thermoplastic on a polymer substrate, and where the members apply pressure against a copy substrate like a sheet of paper to create uniform contact between the copy substrate, and a developed image formed on an imaging member like a photoconductor. The transfer assist member, such as for example a blade, presses the copy sheet into contact with at least the developed image on the photoconductive surface to substantially eliminate any spaces or gaps between the copy sheet and the developed image during transfer of the developed image from the photoconductive surface to the copy substrate.

Figure 1A:
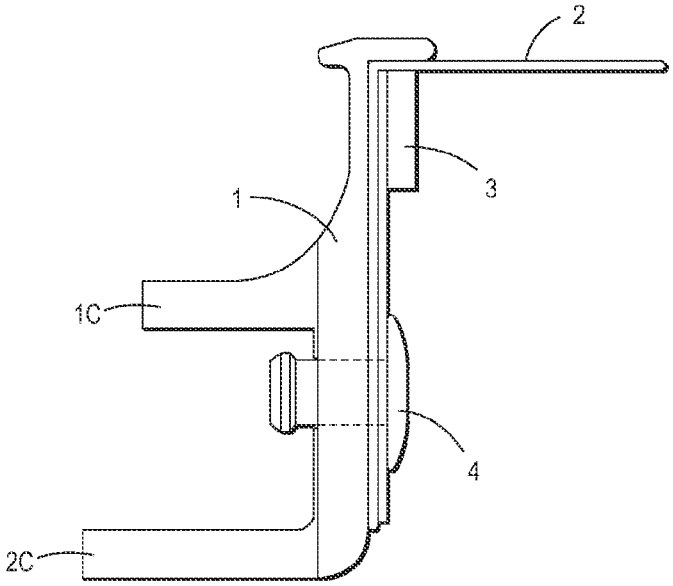
FIGS. 1A and 1B illustrate exemplary side views of the transfer assist member of the present disclosure.
Figure 1B:
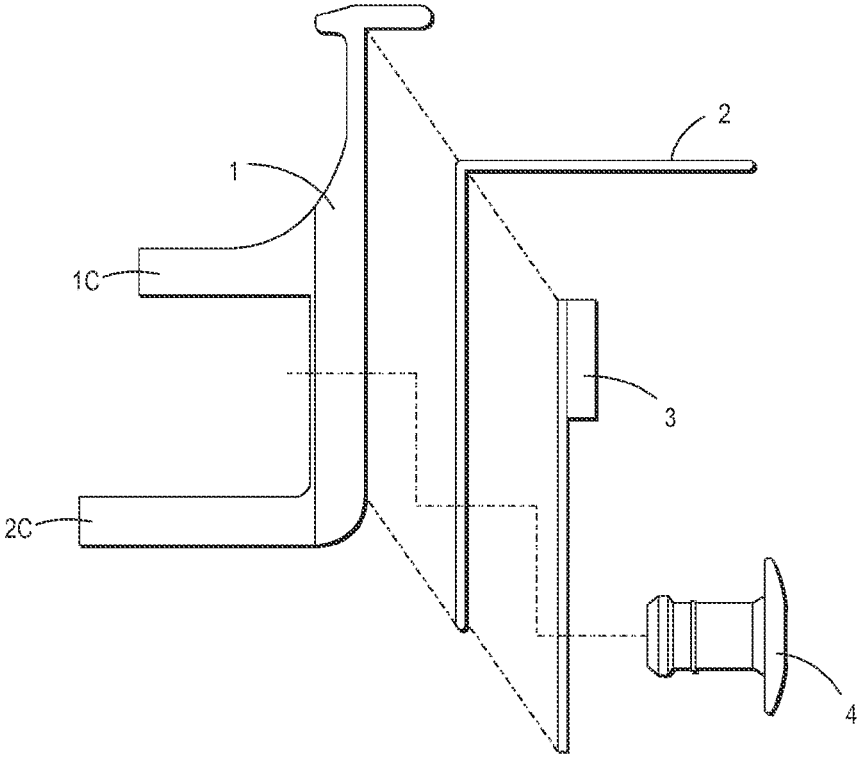

FIG. 1 illustrates a side view of the transfer assist member assembly of the present disclosure. More specifically, illustrated in FIG. 1 is an aluminum component 1 to secure the member, such as a blade (illustrated herein by the transfer assist member petal assembly 2), and which component 1, generated for example by extrusion processes, is attached to the transfer assist member petal assembly 2, and where the petal assembly 2 is including the nine-layer blade member as shown in FIG. 3, and where the numeral or designation 3 (shown in FIGS. 1A, 1B and 2) represents a stainless steel clamp, and the designation 4 (shown in FIGS. 1A, 1B and 2) represents an aluminum rivet, whereby the clamp 3 and rivet 4 retain in position the petal assembly 2, between clamp 3 and aluminum component 1, and where 1C and 2C represent spaced-apart integral arms of element 1.

The corresponding FIG. 1B illustrates the disassembled elements or form of the transfer assist members of the present disclosure where the designations 1, 2, 3, 4, 1C and 2C for this FIG. 1B are the same as those designations as shown in FIG. 1A.

Figure 2:
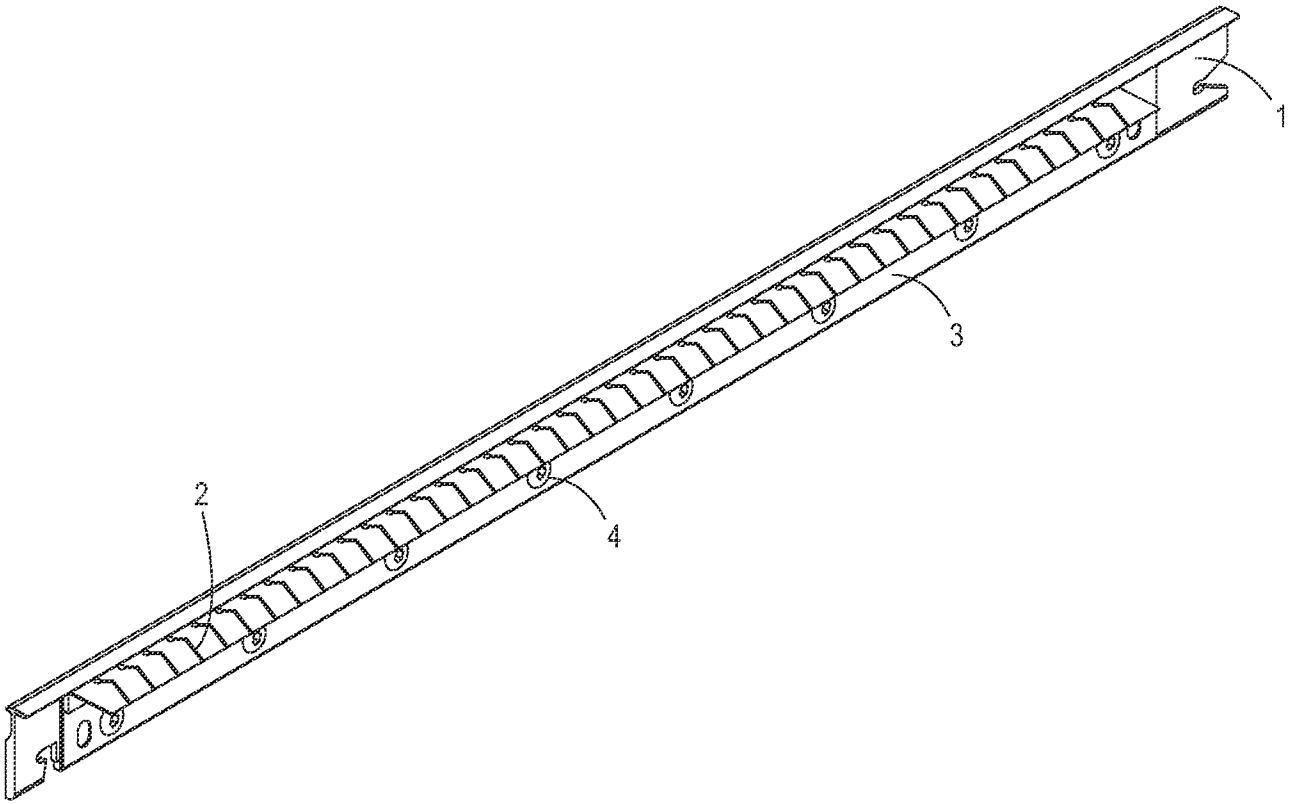
FIG. 2 illustrates an exemplary view of the transfer assist member assembly of the present disclosure.
Figure 3:
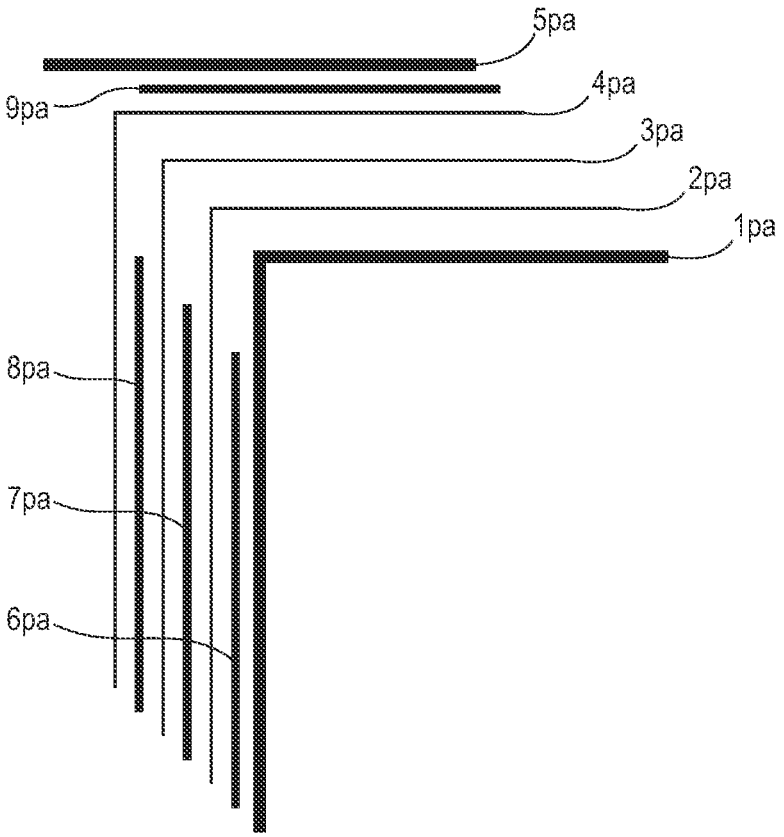
FIG. 3 illustrates an exemplary view of the transfer assist member petal of the present disclosure.

FIG. 2 illustrates another view of the transfer assist member assembly of the present disclosure, and where the designations 1, 2, 3, 4, for this FIG. are the same as the designations as presented in FIG. 1A, that is aluminum component 1 to secure the member, such as a blade, and which element is generated, for example, by extrusion processes, attached to the transfer assist member petal assembly 2, and where the petal assembly 2 includes the five-layer blade member as shown in FIG. 3, and where numeral or designation 3 represents a stainless steel clamp, and designation 4 represents an aluminum rivet, and which clamp and rivet retain in position the petal assembly 2, between designations 3 and 1.

FIG. 3 illustrates the components and compositions of the transfer assist member petal assembly of the present disclosure. More specifically, shown in FIG. 3 is an embodiment of the transfer assist member petal assembly 2 of the present disclosure. Specifically, the transfer assist member petal assembly 2 (shown in FIGS. 1A, 1B and 2) includes the check film layer 1*pa*, which itself includes a thermoplastic overcoat layer present on a polymer substrate, and as an example of such may thus include polymer layers 2*pa*, 3*pa*, and 4*pa*. The transfer assist member petal assembly 2 further includes a top wear resistant layer 5*pa*, and may also include optional adhesive layers 6*pa*, 7*pa*, 8*pa* and 9*pa* between the respective pairs of layers 1*pa* and 2*pa*, 2*pa* and 3*pa*, 3*pa* and 4*pa*, 4*pa* and 5*pa*, as shown in FIG. 3.

Figure 4:
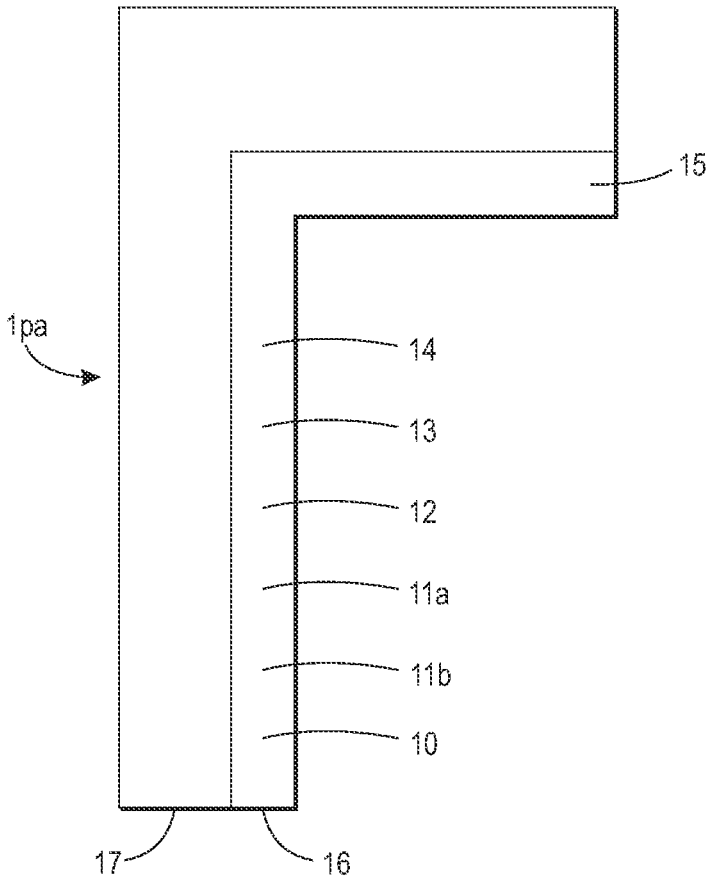
FIG. 4 illustrates an exemplary view of the check film or partially conductive film of the present disclosure.

FIG. 4 illustrates the components and compositions of the transfer assist member check films of the present disclosure. More specifically, shown in FIG. 4 is an embodiment of the check film 1*pa* including supporting substrate layer 17, and a partially conductive thermoplastic overcoat layer 16, which thermoplastic overcoat layer 16 is including thermoplastic polymers 10, nanodiamonds 11*a*, optional conductive components or fillers 11*b*, optional silicas 12, optional fluoropolymer particles 13, optional plasticizers 14, and optional leveling agents 15.

Transfer Assist Member Thermoplastics

Various thermoplastics can be selected for the disclosed transfer assist members, such as check film layer of FIG. 4, designation 16, of the disclosed transfer assist members. Thus, there can be selected thermoplastic or thermo softening plastic polymers that become pliable or moldable above a specific temperature, and return to a solid state upon cooling.

The partially conductive thermoplastic overcoat layer has a resistance intermediate between insulators and conductors, such as for example, a resistance of from about $1\times10^7$ to about $10\times10^9$ ohm, from about $1\times10^8$ to about $10\times10^8$ ohm, from about $1\times10^7$ to about $9.99\times10^9$ ohm, from about $1\times10^7$ to about $10\times10^8$ ohm, and from about $1\times10^8$ ohm to about $9.9\times10^9$ ohm can be selected for the transfer assist members disclosed herein, and which resistance can be determined or measured by a Resistance Meter. The disclosed glass transition temperatures can be determined by a number of known methods, and more specifically, such as by Differential Scanning Calorimetry (DSC). For the disclosed molecular weights, such as $M_w$ (weight average) and $M_n$ (number average), they can be measured by a number of known methods, and more specifically, by Gel Permeation Chromatography (GPC).

Examples of the thermoplastics that can be selected for the transfer assist members of the present disclosure are polycarbonates, polyesters, polysulfones, polyamides, polyimides, polyamideimides, polyetherimides, polyolefins, polystyrenes, polyvinyl halides, polyvinylidene halides, polyphenyl sulfides, polyphenyl oxides, polyaryl ethers, polyether ether ketones, mixtures thereof, and the like.

More specifically, examples of thermoplastics that can be selected for the disclosed mixtures include polyester polymers; aliphatic polyesters, such as polyglycolic acids, polylactic acids, and polycaprolactones; aliphatic copolyesters such as polyethylene adipates and polyhydroxyalkanoates; and aromatic copolyesters such as polyethylene terephthalates (PET), polybutylene terephthalates (PBT), polytrimethylene terephthalates (PTT), polyethylene naphthalates (PEN). Specific aromatic copolyesters include VITEL® 1200B ($T_g$=69° C., $M_w$=45,000, a copolyester prepared from ethylene glycol, diethylene glycol, terephthalic acid, and isophthalic acid), 3300B ($T_g$=18° C., $M_w$=63,000), 3350B ($T_g$=18° C., $M_w$=63,000), 3200B ($T_g$=17° C., $M_w$=63,500), 3550B ($T_g$=−11° C., $M_w$=75,000), 3650B ($T_g$=−10° C., $M_w$=73,000), 2200B ($T_g$=69° C., $M_w$=42,000), a copolyester prepared from ethylene glycol, diethylene glycol, neopentyl glycol, terephthalic acid, and isophthalic acid), 2300B ($T_g$=69° C., $M_w$=45,000), all available from Bostik.

Thermoplastic polycarbonate polymer examples that can be selected for the disclosed mixtures include poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, the thermoplastic polymers include bisphenol-A-polycarbonate resins, commercially available as MAKROLON® or FPC® with, for example, a weight average molecular weight of from about 50,000 to about 500,000, or from about 225,000 to about 425,000.

Polysulfone thermoplastic examples selected for the disclosed mixtures include polyphenylsulfones such as RADEL® R-5000NT, and 5900NT; polysulfones such as UDEL® P-1700, P-3500; and polyethersulfones such as RADEL® A-200A, AG-210NT, AG-320NT, VERADEL® 3000P, 3100P, 3200P, all available or obtainable from Solvay Advanced Polymers, LLC, Alpharetta, Ga.

Polyphenylene sulfide thermoplastic polymers that can be selected for the disclosed mixtures include RYTON® polyphenylene sulfide, available from Chevron Phillips as a crosslinked polymer; FORTRON® polyphenylene sulfide available from Ticona Incorporated as a linear polymer; and SULFAR® polyphenylene sulfide available from Testori Incorporated.

Thermoplastic polyamide polymers that can be selected for the disclosed mixtures include aliphatic polyamides, such as Nylon 6 and Nylon 66 from DuPont; semi aromatic polyamides, or polyphthalamides such as TROGAMID® 6T from Evonik Industries; and aromatic polyamides, or aramides such as KEVLAR® and NOMEX® available from E.I. DuPont, and TEIJINCONEX®, TWARON® and TECHNORA® available from Teijin Incorporated.

Examples of thermoplastic polyether ether ketone polymers that can be selected for the disclosed mixtures include VICTREX® PEEK 90G, 150G, 450G, 150FC30, 450FC30, 150FW30, 450FE20, WG101, WG102, ESD101, all available from VICTREX Manufacturing Limited.

Polyamideimides thermoplastic examples that can be selected for the disclosed mixtures include TORLON® Al-10 ($T_g$=272° C.), commercially available from Solvay Advanced Polymers, LLC, Alpharetta, Ga.

Examples of polyetherimide polymers that can be selected for the disclosed mixtures include ULTEM® 1000 ($T_g$=210° C.), 1010 ($T_g$=217° C.), 1100 ($T_g$=217° C.), 1285, 2100 ($T_g$=217° C.), 2200 ($T_g$=217° C.), 2210 ($T_g$=217° C.), 2212 ($T_g$=217° C.), 2300 ($T_g$=217° C.), 2310 ($T_g$=217° C.), 2312 ($T_g$=217° C.), 2313 ($T_g$=217° C.), 2400 ($T_g$=217° C.), 2410 ($T_g$=217° C.), 3451 ($T_g$=217° C.), 3452 ($T_g$=217° C.), 4000 ($T_g$=217° C.), 4001 ($T_g$=217° C.), 4002 ($T_g$=217° C.), 4211 ($T_g$=217° C.), 8015, 9011 ($T_g$=217° C.), 9075, and 9076, all commercially available from Sabic Innovative Plastics.

Examples of polyimide polymers that can be selected for the disclosed mixtures include P84® polyimide available from HP Polymer Inc., Lewisville, Tex.

The thermoplastics are present in a number of differing effective amounts, such as for example, from about 30 to about 99 weight percent, from about 90 to about 99 weight percent, from about 80 to about 90 weight percent, from about 65 to about 75 weight percent, from about 50 to about 60 weight percent, from about 30 to about 50 weight percent providing the total percent of components present is about 100 percent, and wherein the weight percent is based on the total solids, such as solids of the thermoplastics, the nanodiamond, the conductive component or filler, the plasticizer when present, silica when present, and the fluoropolymers when present.

The thermoplastic overcoat layer can be included in a number of thicknesses, such as from about 0.1 to about 50 microns, from about 1 to about 40 microns, and from about 5 to about 20 microns.

Nanodiamonds

The thermoplastic overcoat layer further includes nanodiamonds produced using detonation of diamond blend. The nanodiamond can include a spectrum of functional chemical groups (carbon: approximately 76%; oxygen: approximately 6%; and nitrogen: approximately 10%) with directly linked carbon structures, thus rendering the nanodiamond materials electrically conductive. A completed overcoat layer may include one or more polycarbonates, one or more polyesters, carbon black, natural or synthetic nanodiamond, and a plasticizer.

Nanodiamonds have excellent mechanical properties, high surface areas and tunable surface structures. They are also non-toxic, making them well-suited to biomedical applications. The nanodiamond material may be either natural, synthetic, or both. The nanodiamond used in the coating may be a material produced by detonation of diamond blend, which is then chemically purified. In an embodiment, a plurality of diamond crystals used with an embodiment of the coating may have an average diameter of from about 1 to about 1,000 nanometers (nm), or from about 2 nm to about 500 nm, or from 3 to about 200 nm, for example an average diameter of about 5 nm, 50 nm, or 100 nm. In an embodiment, the total surface area of diamonds used may be from about 30 to about 500 $m^2/g$, or from about 150 to about 450 $m^2/g$, or from about 270 $m^2/g$ and about 380 $m^2/g$. The unique rounded shape of nanodiamonds produced using detonation of diamond blend (i.e., detonation nanodiamonds) provides good lubricity characteristics while offering the hardness and wear resistance of diamond. Nanodiamond combines diamond hardness core chemical inertia with an active surface. The surface of nanodiamonds produced using detonation of diamond blend includes a spectrum of functional chemical groups (carbon: approximately 76%; oxygen: approximately 6%; and nitrogen: approximately 10%) with directly linked carbon structures, thus rendering the nanodiamond materials electrically conductive. Suitable nanodiamonds are available from Nano-Blox, Inc. of Delray Beach, Fla. Nanodiamonds are available in either powder form or dispersion form. Nanodiamond black (NB50) possesses 50% of $sp^3$ carbon and 50% of $sp^2$ carbon ($sp^3$ diamond core and $sp^2$ graphite envelop, Brunauer, Emmet, Teller [BET] surface area ~460 $m^2/g$); nanodiamond (NB90) possesses 90% of $sp^3$ carbon and 10% of $sp^2$ carbon ($sp^3$ diamond core and $sp^2$ graphite envelop, BET surface area ~460 $m^2/g$). Surface modified nanodiamond materials are also available including —OH, —COOH, —$NH_2$ or quarternerized. These materials are readily dispersed in either aqueous or solvent dispersions. Natural nanodiamond materials, for example NDP-Natural #0.050 with sizes of 0-0.1 micron, are available from Advanced Abrasives Corp. of Pennsauken, N.J.

The nanodiamonds are present in an amount of from about 1 to about 30 weight percent, or from about 5 to about 25 weight percent, or from about 10 to about 20 weight percent of the thermoplastic overcoat layer.

Optional Conductive Fillers

The thermoplastic containing layer can further include optional conductive components, such as known carbon forms like carbon black, graphite, carbon nanotube, fullerene, graphene, and the like; metal oxides, mixed metal oxides, conducting polymers such as polyaniline, polythiophene, polypyrrole, mixtures thereof, and the like.

Examples of carbon black conductive filler components that can be selected for incorporation into the thermoplastic overcoat layer illustrated herein include Ketjenblack® carbon blacks available from AkzoNobel Functional Chemicals, special black 4 (B.E.T. surface area=180 $m^2/g$, DBP absorption=1.8 ml/g, primary particle diameter=25 nanometers) available from Evonik-Degussa, special black 5 (B.E.T. surface area=240 $m^2/g$, DBP absorption=1.41 ml/g, primary particle diameter=20 nanometers), color black FW1 (B.E.T. surface area=320 $m^2/g$, DBP absorption=2.89 ml/g, primary particle diameter=13 nanometers), color black FW2 (B.E.T. surface area=460 $m^2/g$, DBP absorption=4.82 ml/g, primary particle diameter=13 nanometers), color black FW200 (B.E.T. surface area=460 $m^2/g$, DBP absorption=4.6 ml/g, primary particle diameter=13 nanometers), all available from Evonik-Degussa; VULCAN® carbon blacks, REGAL® carbon blacks, MONARCH® carbon blacks, EMPEROR® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), EMPEROR® 1200, EMPEROR® 1600, VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); special carbon blacks available from Evonik Incorporated; and Channel carbon blacks available from Evonik-Degussa. Other known suitable carbon blacks not specifically disclosed herein may be selected as the filler or conductive component.

Examples of polyaniline fillers that can be selected for incorporation into the disclosed thermoplastic overcoat layer are PANIPOL™ F, commercially available from Panipol Oy, Finland; and known lignosulfonic acid grafted polyanilines. These polyanilines usually have a relatively small particle size diameter of, for example, from about 0.5 to about 5 microns; from about 1.1 to about 2.3 microns, or from about 1.5 to about 1.9 microns.

Metal oxide fillers that can be selected for the disclosed thermoplastic overcoat layer include, for example, tin oxide, antimony doped tin oxide, indium oxide, indium tin oxide, zinc oxide, and titanium oxide, and the like.

When present, the filler and fillers can be selected in an amount of, for example, from about 1 to about 70 weight percent, from about 3 to about 40 weight percent, from about 4 to about 30 weight percent, from about 10 to about 30 percent, from about 3 to about 30 weight percent, from about 8 to about 25 weight percent, or from about 13 to about 20 weight percent of the total solids of the thermoplastic overcoat layer.

Optional Plasticizers

Optional plasticizers, which can be considered plasticizers that primarily increase the plasticity or fluidity of a material like the thermoplastic selected for the disclosed transfer assist members, include, diethyl phthalate, dioctyl phthalate, diallyl phthalate, polypropylene glycol dibenzoate, di-2-ethyl hexyl phthalate, diisononyl phthalate, di-2-propyl heptyl phthalate, diisodecyl phthalate, di-2-ethyl hexyl terephthalate, and other known suitable plasticizers. The plasticizers can be utilized in various effective amounts, such as for example, from about 0.1 to about 30 weight percent, from about 1 to about 20 weight percent, and from about 3 to about 15 weight percent.

Optional Silicas

Optional silica examples, which can contribute to the wear resistant properties of the members and blades illustrated herein, include silica, fumed silicas, surface treated silicas, other known silicas, such as AEROSIL R972®, mixtures thereof, and the like. The silicas are selected in various effective amounts, such as for example, from about 0.1 to about 20 weight percent, from about 1 to about 15 weight percent, and from about 2 to about 10 weight percent.

Optional Fluoropolymer Particles

Optional fluoropolymer particles, which can contribute to the wear resistant properties of the members and blades illustrated herein, include tetrafluoroethylene polymers (PTFE), trifluorochloroethylene polymers, hexafluoropropylene polymers, vinyl fluoride polymers, vinylidene fluoride polymers, difluorodichloroethylene polymers, or copolymers thereof. The fluoropolymer particles for the check film layer are selected in various effective amounts, such as for example, from about 0.1 to about 20 weight percent, from about 1 to about 15 weight percent, and from about 2 to about 10 weight percent.

Optional Leveling Agents

Optional leveling agent examples, which can contribute to the smoothness characteristics, such as enabling smooth coating surfaces with minimal or no blemishes or protrusions, of the members and blades illustrated herein include polysiloxane polymers or fluoropolymers. The optional polysiloxane polymers include, for example, a polyester modified polydimethylsiloxane with the trade name of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane with the trade name of BYK® 333, BYK® 330 (about 51 weight percent in methoxypropylacetate) and BYK® 344 (about 52.3 weight percent in xylene/isobutanol=80/20), BYK®-SILCLEAN 3710 and 3720 (about 25 weight percent in methoxypropanol); a polyacrylate modified polydimethylsiloxane, with the trade name of BYK®-SILCLEAN 3700 (about 25 weight percent in methoxypropylacetate); or a polyester polyether modified polydimethylsiloxane with the trade name of BYK® 375 (about 25 weight percent in di-propylene glycol monomethyl ether), all commercially available from BYK Chemical. The leveling agents for the check film layer are selected in various effective amounts, such as for example, from about 0.01 to about 5 weight percent, from about 0.1 to about 3 weight percent, and from about 0.2 to about 1 weight percent.

Polymer Layer Substrates

The thermoplastic polymer having incorporated therein the components as illustrated herein, such as nanodiamonds and other fillers, are included on a supporting polymer layer substrate, such as substrate layer 17, examples of which are polyesters, such as polyethylene terephthalate (PET), polybutylene terephthalate (PBT), and polyethylene naphthalate (PEN), polyamides, polyetherimides, polyamideimides, polyimides, polyphenyl sulfides, polyether ether ketones, polysulfones, polycarbonates, polyvinyl halides, polyolefins, mixtures thereof, and the like. The polymer layer substrate can be of a number of different thicknesses, such as from about 25 to about 250 microns, or from about 50 to about 200 microns, or from about 75 to about 150 microns, and where the check film total thickness is, for example, from about 1 to about 10 mils, from about 1 to about 8 mils, from about 1 to about 5 mils, from about 2 to about 4 mils, and more specifically, about 3.8 mils, measured by known means such as a Permascope.

Additional Transfer Assist Member Layers

The transfer assist member further include suitable polymer layers 2*pa*, 3*pa* and 4*pa*. Examples of these polymer layers include MYLAR®, MELINEX®, TEIJIN®, TETORON®, and TEONEX®, considered to be bi-axially oriented polyester films which are commercially available in a variety of finishes and thicknesses. These and other similar polymers are available from E.I. DuPont Company or SKC Incorporated. These layers are each of effective thicknesses of, for example, from about 1 to about 20 mils, from about 1 to about 12 mils, from about 5 to about 7 mils, and more specifically, about 5 mils where one mil is equal to 0.001 of an inch (0.0254 mm).

Top Wear Resistant Layer

The top wear resistant layer designated, for example, by the numeral 5*pa*, illustrated in FIG. 3, can be comprised of various suitable known and commercially available materials, such as polyolefins like ultra-high molecular weight polyethylenes (UHMW), a wear-resistant plastic with a low coefficient of friction, excellent impact strength, and possessing chemical and moisture resistance. UHMW comprises long chains of polyethylene of the formula illustrated below, which aligns in the same direction, and derives its strength largely from the length of each individual molecule (chain)

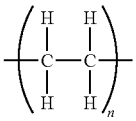

wherein n represents the number of repeating segments of at least about 100,000, and more specifically, from about 100,000 to about 300,000, and from about 150,000 to about 225,000.

The thickness of the disclosed top wear resistant layer can vary depending, for example, on the thicknesses of the other layers that may be present and the components in each layer. Thus, for example, the thicknesses of the top wear resistant layer can vary of from about 1 to about 20 mils, from about 1 mil to about 15 mils, from about 2 to about 10 mils, or from about 1 mil to about 5 mils as determined by known means such as a Permascope.

Optional Adhesives

Optional adhesive layers designated, for example, as 6*pa*, 7*pa*, 8*pa*, and 9*pa* in FIG. 3, can be included between each of the transfer assist member layers, or partially included at the edges between each of the member layers.

The optional adhesive layers may also be included between each of the layers of the transfer assist members of FIG. 3, such as on the vertical sides between the substrate side of layer 1*pa* and layer 2*pa*, layers 2*pa* and 3*pa*, layers 3*pa* and 4*pa*, and on the horizontal sides between layer 4*pa* and the top wear resistant layer 5*pa*. The horizontal sides of layers 1*pa*, 2*pa*, 3*pa* and 4*pa* are usually not bonded together. A number of known adhesives can be selected for each adhesive layer, inclusive of suitable polyesters, a 3M™ Double Coated Tape 444, which is a 3.9 mil thick, 300 high tack acrylic adhesive with a 0.5 mil thick polyester carrier, white, densified Kraft paper liner (55 lbs), mixtures thereof, and the like.

Specific embodiments will now be described in detail. These examples are intended to be illustrative, and not limited to the materials, conditions, or process parameters set forth in these embodiments. All parts are percentages by solid weight unless otherwise indicated.

A transfer assist blade including a check film comprising a nanodiamond-containing thermoplastic overcoat layer on a polymer layer substrate may be prepared as follows, although other embodiments are also contemplated:

Preparation of the Partially Conductive Nanodiamond-Containing Thermoplastic Overcoat Layer Dispersion A partially conductive coating in accordance with an embodiment of the present teachings includes a dispersion of nanodiamonds to provide a layer having sufficient electrical characteristics and resistance to wear. During use, the transfer assist blade is exposed, and physically contacts the print medium and may physically contact the photoreceptor. In addition to nanodiamonds, the coating dispersion may include a thermoplastic, carbon black, a plasticizer. The thermoplastic may be a polycarbonate, a polyester, etc., and mixtures thereof. The coating materials, in a solvent of, for example, methylene chloride, may be extrusion coated onto a polymer layer substrate such as a PET film, for example a 4 mil thick PET. After application, the coating may be dried, for example at a temperature of between about 110 and 140° C., for example about 120° C., for between about 60 seconds and about 300 seconds, for example 2 minutes. The resulting check film, including the nanodiamond-containing thermoplastic overcoat layer, meets a $10^8$ ohm resistance specification, possesses good adhesion to the PET film substrate, and demonstrates better rub/wear resistance than the thermoplastic overcoat layer having no nanodiamond incorporated.

The thermoplastic overcoat layer dispersion may be prepared using any suitable technique. In an embodiment, the overcoat materials including a polycarbonate, a polyester, a carbon black, a nanodiamond, and a plasticizer may be ball milled in a solvent. In one embodiment, the materials may be mixed to include: polycarbonate A (for example FPC-0170 from Mitsubishi Gas Chemical of Japan) in an amount of between about 46 wt % and about 48 wt %, or about 46.4 wt %; a VITEL® 1200B polyester (for example from Bostik of Wauwatosa, Wis.) in an amount between about 14 wt % and about 17 wt %, for example about 15.5 wt %; an EMPEROR® 1200 carbon black (available from Cabot Corp. of Haverhill, Mass.) in an amount between about 8 wt % and about 12 wt %, for example about 10.0 wt %; an NDP-Natural #0.050 nanodiamond (available from Advanced Abrasive Corp., above) in an amount of between about 8.5 wt % and about 11.5 wt %, for example about 9.9 wt %; and a diethyl phthalate plasticizer in an amount of between about 17 wt % and about 19 wt %, for example about 18.2 wt %. This materials may be mixed in a methylene chloride solvent, which is about 7.0 wt % and about 9.0 wt % solid, for example about 8.0 wt % solid. The mixture include the materials and solvent may be ball milled for at least 15 hours, or for at least 20 hours, or for about 20 hours.

After ball milling the overcoat layer mixture of the materials and solvent may be filtered to remove impurities and/or larger particles using, for example, a 20-micron Nylon cloth filter to obtain the final dispersion.

Preparation of the Partially Conductive Check Film

The final dispersion including the nanodiamond may then be coated onto a polymer layer substrate, for example a 4 mil thick PET using, for example, a lab draw bar coater or a production extrusion coater. After coating, the final dispersion may be cured or dried to remove the solvent component, for example at a temperature of between about 110° C. and 130° C., for example about 120° C., for between about 90 seconds and about 180 seconds, for example 2 minutes. The final coating may be a flat 15 micron thick polycarbonate/polyester/nanodiamond overcoat layer on the 4 mil thick PET substrate. A surface of the final coating (overcoat) may be exposed during use, while a surface of the PET check film remains covered by the final coating and unexposed during use.

The resistance of the polycarbonate/polyester/nanodiamond blend overcoat layer was measured at about $4.5\times10^8$ ohm. The measured resistivity was uniform across an entire 2.5 inch×17 inch sample strip, and each measurement was within 1 decade $10^8$ ohm/sq.

A rub/wear test to simulate a typical wear situation during use has shown that, after 1 million rub/wear cycles, the disclosed nanodiamond-containing check film showed less than 25% of the wear spots of a check film containing no nanodiamond.

Preparation of the Petal Assembly of the Transfer Assist Member

The above prepared disclosed check film (15 microns thick partially conductive thermoplastic layer on the 4 mil thick PET polymer layer), and three separate 5 mil thick MYLAR® PET films were cut into 4 millimeter by 38 millimeter strips, and the strips were aligned in the sequence of MYLAR® PET film, MYLAR® PET film, and MYLAR® PET film, with the disclosed check film/PET substrate facing the MYLAR® PET film. Each adjacent pair of the aforementioned layers were bonded together using 3M™ Double Coated Tape 444 in between from the edges of the long sides to about 2.5 millimeters inside. The partially bonded layers were folded rendering the 2.5-millimeters wide bonded layers into a vertical position and the 1.5-millimeters wide unbounded layers into a horizontal position.

UHMW polyethylene, obtained from E.I. DuPont, believed to be of the following formula/structure top wear resistant layer was then bonded to the horizontal section of the top MYLAR® PET film. The horizontal segments of the above layers were then cut into about 40 smaller segments with rectangular shapes

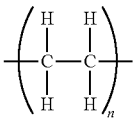

wherein n represents the number of repeating segments of from about 150,000 to about 225,000. The thickness of this layer was about 10 mils as determined by a Permascope.

The aluminum extruded component 1 of FIG. 1 was then attached to the above transfer assist member petal assembly, and then attached to the transfer assist member stainless steel clamp assembly by the transfer assist member aluminum rivet as illustrated herein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A transfer assist member comprising a plurality of layers, one of said layers being a check film layer comprised of a nanodiamond-containing thermoplastic overcoat layer on a polymer layer, wherein:

the overcoat layer further includes a conductive component of carbon black, graphite, metal oxide, polyaniline, polythiophene, polypyrrole, or mixtures thereof, silica, and plasticizer; and said thermoplastic is a polycarbonate, a polyester, or mixtures thereof, and said polymer layer is comprised of a polyethylene terephthalate or a polyethylene naphthalate.

2. The transfer assist member of claim 1, wherein the nanodiamonds comprises between 1 weight percent (wt %) and 30 wt % of the overcoat layer.

3. The transfer assist member of claim 2, wherein the nanodiamonds have an average diameter of from about 1 to about 1,000 nanometers.

4. The transfer assist member of claim 2, wherein the nanodiamonds have a total surface area of from about 30 to about 400 $m^2/g$.

5. The transfer assist member of claim 2, wherein the nanodiamonds are detonation nanodiamonds having a rounded shape.

6. The transfer assist member of claim 5, wherein the detonation nanodiamonds have functional chemical groups including carbon, oxygen, and nitrogen.

7. The transfer assist member of claim 1, wherein said thermoplastic is selected from the group consisting of polycarbonates, polyesters, polysulfones, polyamides, polyimides, polyamideimides, polyetherimides, polyolefins, polystyrenes, polyvinyl halides, polyvinylidene halides, polyphenyl sulfides, polyphenyl oxides, polyaryl ethers, polyether ether ketones, and mixtures thereof.

8. The transfer assist member of claim 1, wherein said overcoat layer further includes a conductive component of carbon black.

9. The transfer assist member of claim 1, wherein said overcoat layer further includes carbon black, graphite, silica, polytetrafluoroethylene, a plasticizer, a polysiloxane copolymer, or mixtures thereof.

10. The transfer assist member of claim 1, wherein said polymer layer is comprised of a polyester, a polyamide, a polyetherimide, a polyamideimide, a polyimide, a polyphenyl sulfide, a polyether ether ketone, a polysulfone, a polycarbonate, a polyvinyl halide, a polyolefin, or mixtures thereof.

11. The transfer assist member of claim 1, wherein said polymer layer is comprised of a polyethylene terephthalate or a polyethylene naphthalate.

12. The transfer assist member of claim 1, wherein said plasticizer is selected from the group consisting of diethyl phthalate, dioctyl phthalate, diallyl phthalate, polypropylene glycol dibenzoate, di-2-ethyl hexyl phthalate, diisononyl phthalate, di-2-propyl heptyl phthalate, diisodecyl phthalate, and di-2-ethyl hexyl terephthalate.

13. The transfer assist member of claim 1, wherein the plurality of layers is from 2 layers to 10 layers.

14. The transfer assist member of claim 1, wherein said plurality of layers is comprised of at least three separate polymer layers of a bottom layer, an middle layer and a top layer, and which bottom layer is in contact with the polymer layer of said check film and a single top wear resistant layer in contact with said top polymer layer.

15. The transfer assist member of claim 14, wherein said top wear resistant layer is comprised of polyethylene.

16. A method for forming a transfer assist member, comprising:

forming a thermoplastic overcoat layer mixture using a method comprising mixing a polycarbonate, a polyester, a carbon black, a plurality of nanodiamonds, and a plasticizer with a solvent;

filtering the overcoat layer mixture to obtain a final dispersion;

coating a polymer layer substrate with the final dispersion; and curing the final dispersion to remove the solvent and to form the overcoat layer including a conductive component of carbon black, graphite, metal oxide, polyaniline, polythiophene, polypyrrole, or mixtures thereof, silica, and plasticizer and to form the thermoplastic, wherein the thermoplastic is a polycarbonate, a polyester, or mixtures thereof, and said polymer layer substrate comprises a polyethylene terephthalate or a polyethylene naphthalate.

17. A xerographic process for providing substantially uniform contact between a copy substrate and a toner developed image located on an imaging member comprising a toner transfer flexible assist member that comprises a plurality of adhesive bonded layers, wherein, the xerographic process comprises:

moving said flexible transfer assist member from a non-operative position spaced from the imaging member to an operative position in contact with the copy substrate on the imaging member;

applying pressure against the copy substrate in a direction toward the imaging member, wherein:

said plurality of adhesive bonded layers comprise a wear resistant layer and a check film layer;

the check film layer comprises a thermoplastic layer present on a polymer substrate of a polyalkylene terephthalate, a polyester, or mixtures thereof, wherein:

the thermoplastic is formed using a method comprising:

forming a thermoplastic overcoat layer mixture using a method comprising mixing a polycarbonate, a polyester, a carbon black, a plurality of nanodiamonds, and a plasticizer with a solvent;

filtering the overcoat layer mixture to obtain a final dispersion;

coating a polymer layer substrate with the final dispersion; and curing the final dispersion to remove the solvent and to form the overcoat layer including a conductive component of carbon black, graphite, metal oxide, polyaniline, polythiophene, polypyrrole, or mixtures thereof, silica, and plasticizer and to form the thermoplastic, wherein the thermoplastic is a polycarbonate, a polyester, or mixtures thereof, and said polymer layer substrate comprises a polyethylene terephthalate or a polyethylene naphthalate;

said thermoplastic is selected from the group consisting of a polycarbonate, a polyester, a polysulfone, a polyamide, a polyimide, a polyamideimide, a polyetherimide, a polyaryl ether, a polyether ether ketone, a polyphenyl sulfide and mixtures thereof, and said thermoplastic layer further comprises the plurality of nanodiamonds and at least one of a conductive filler, silica, a plasticizer, a fluoropolymer, a polysiloxane and mixtures thereof.

18. The xerographic process of claim 17, further comprising forming said plurality of layers to comprise three polyester layers situated between said check film and said wear resistant layer, wherein said thermoplastic is a polycarbonate, a polyester, and mixtures thereof, and wherein said wear resistant layer is comprised of a polyethylene as represented by the following formulas/structures:

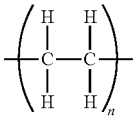

wherein n represents the number of repeating segments from about 100,000 to about 300,000, and the method further comprises transferring from about 95 to about 100 percent of the toner developed image to said copy substrate comprised of paper, and wherein said thermoplastic overcoat layer has a resistance of from about 1×107 to about 10×109 ohm as measured by a Resistance Meter.

* * * * *